US007883366B2

(12) United States Patent
Davis et al.

(10) Patent No.: US 7,883,366 B2
(45) Date of Patent: Feb. 8, 2011

(54) HIGH DENSITY CONNECTOR ASSEMBLY

(75) Inventors: Wayne Samuel Davis, Harrisburg, PA (US); Robert Neil Whiteman, Jr., Middletown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/363,867

(22) Filed: Feb. 2, 2009

(65) Prior Publication Data

US 2010/0197149 A1 Aug. 5, 2010

(51) Int. Cl.
*H01R 13/648* (2006.01)

(52) U.S. Cl. ..... 439/607.01

(58) Field of Classification Search ..... 439/607.01
See application file for complete search history.

(56) References Cited

U.S. PATENT DOCUMENTS

| | | | | |
|---|---|---|---|---|
| 3,115,379 | A | 12/1963 | McKee | |
| 4,703,394 | A | 10/1987 | Petit et al. | |
| 5,429,521 | A | 7/1995 | Morlion et al. | |
| 6,227,882 | B1 | 5/2001 | Ortega et al. | |
| 6,347,962 | B1 | 2/2002 | Kline | |
| 6,371,773 | B1 | 4/2002 | Crofoot et al. | |
| 6,447,340 | B1 | 9/2002 | Wu | |
| 6,572,409 | B2 * | 6/2003 | Nitta et al. | 439/607.05 |
| 6,607,401 | B1 | 8/2003 | Weaver, Jr. et al. | |
| 6,607,402 | B2 | 8/2003 | Cohen et al. | |
| 6,672,907 | B2 * | 1/2004 | Azuma | 439/682 |
| 6,717,825 | B2 | 4/2004 | Volstorf | |
| 6,758,695 | B2 | 7/2004 | Pepe et al. | |
| 6,780,059 | B1 | 8/2004 | Payne et al. | |
| 6,988,902 | B2 | 1/2006 | Winings et al. | |
| 7,108,556 | B2 | 9/2006 | Cohen et al. | |
| 7,331,802 | B2 | 2/2008 | Rothermel et al. | |
| 7,517,250 | B2 * | 4/2009 | Hull et al. | 439/607.05 |
| 2004/0043672 | A1 | 3/2004 | Shuey et al. | |
| 2004/0092140 | A1 | 5/2004 | Mashiyama et al. | |
| 2005/0148239 | A1 | 7/2005 | Hull et al. | |
| 2006/0024984 | A1 | 2/2006 | Cohen et al. | |
| 2006/0073709 | A1 | 4/2006 | Reid | |

FOREIGN PATENT DOCUMENTS

| | | | |
|---|---|---|---|
| EP | 0 806 814 | A2 | 11/1997 |
| EP | 0 924 812 | A1 | 6/1999 |
| EP | 1049201 | | 11/2000 |
| EP | 1 220 361 | A1 | 7/2002 |
| EP | 1220361 | | 7/2002 |
| EP | 1398852 | | 3/2004 |
| WO | WO 99/56352 | A2 | 11/1999 |
| WO | WO 2007/037902 | A1 | 4/2007 |

OTHER PUBLICATIONS

European Search Report, Application No. EP 10 15 2310, International Filing Date Jan. 2, 2010.

* cited by examiner

*Primary Examiner*—Truc T Nguyen

(57) ABSTRACT

A connector assembly includes an array of signal contacts having mating portions configured for mating engagement with corresponding signal contacts of a mating connector assembly. The assembly also includes a housing holding the array of signal contacts in rows and columns. The signal contacts are arranged along axes of the rows and columns, and the mating portions of the signal contacts are oriented at a non-orthogonal angle relative to the axes of the rows and columns.

20 Claims, 10 Drawing Sheets

HIGH DENSITY CONNECTOR ASSEMBLY

BACKGROUND OF THE INVENTION

The subject matter herein relates generally to connector systems that connect circuit boards, and more particularly to high density connector assemblies.

Some electrical systems, such as network switches or a computer server with switching capability, include large backplanes or midplanes with several daughter cards, such as switch cards or line cards, plugged into the backplane or midplane. Generally, the line cards bring data from external sources into the system. The switch cards contain circuitry that may switch data from one line card to another. Traces in the backplane interconnect the line cards and the appropriate switch cards. The electrical systems utilize electrical connectors to interconnect the circuit boards defining the cards to the circuit board defining the backplane or midplane. In some applications, the circuit boards defining the cards may be oriented orthogonal to the circuit board defining the backplane or midplane. Typically, one of the electrical connectors is a right angle connector mounted to an edge of one of the cards. The other electrical connector is typically a header connector mounted to the backplane or midplane. Other header connectors may be connected to the backplane or midplane as well, and the backplane or midplane is used to interconnect the pins of the two header connectors. In some systems, the header connectors are mounted to both sides of the backplane or midplane.

Known electrical systems that utilize right angle connectors and header connectors mounted to a backplane of midplane are not without disadvantages. For instance, a large number of switch cards and line cards are typically connected to the backplane or midplane, which increases the overall size of the backplane or midplane. The density of the electrical connectors has an impact on the overall size of the electrical connectors, and thus the overall size of the backplane or midplane. The density may be expressed in terms of the number of signal contacts or pairs of signal contacts per linear inch along the backplane or midplane. While decreasing the spacing between the signal contacts is one way of increasing the density, decreasing the spacing negatively affects the electrical performance of the electrical connector. The amount of undesirable coupling between adjacent signal contacts is based at least in part on the distance between the signal contacts. As such, merely changing the spacing between the signal contacts may not be an effective way to increase the density of the electrical connector, as the electrical connector may not perform adequately.

Thus, providing a high density electrical connector with minimal signal loss remains a challenge.

BRIEF DESCRIPTION OF THE INVENTION

In one embodiment, an orthogonal connector assembly is provided that includes an array of signal contacts having mating portions configured for mating engagement with corresponding signal contacts of a mating connector assembly. The assembly also includes a housing holding the array of signal contacts in rows and columns. The signal contacts are arranged along axes of the rows and columns, and the mating portions of the signal contacts are oriented at a non-orthogonal angle relative to the axes of the rows and columns.

Optionally, the mating portions may have broadside surfaces that are angled with respect to the row axes and the column axes. The mating portions may be generally planar and may define mating planes that are transverse to the column axes. The mating portions may extend along a central axis, where the central axes of adjacent signal contacts within the rows and/or the columns are offset with respect to the corresponding row axes and column axes. Optionally, the housing may include channels therethrough defined by channel walls, where the channels are aligned with the signal contacts. The channels may be arranged generally along the channel row axes and channel-column axes, and the channel walls may be transverse to the channel row axes and the channel column axes. Optionally, The assembly may also include a plurality of contact modules held by the housing, where the contact modules having a contact module body. The signal contacts may be held by the contact module body along a conductor plane. The mating portions may extend from an edge of the contact module body such that the mating portions lie transverse to the conductor plane. A plurality of shields may be coupled to corresponding contact modules, where the shields have shielded mating portions interspersed with the mating portions of selected signal contacts such that the shield mating portions are generally arranged along the row axes and the column axes. The mating portion may extend along a central axis, where the mating portion is twisted about the central axis to approximately a 45° angle with respect to an adjacent portion of the signal contact.

In another embodiment, an orthogonal connector assembly is provided that includes an array of signal contacts having mating portions configured for mating engagement with corresponding signal contacts of a mating connector assembly. The mating portions have broadside surfaces and edgeside surfaces. The mating portions define corners at the intersections of the broadside surfaces and the edgeside surfaces. A housing holds the array of signal contacts in rows and columns, wherein the mating portions of/the signal contacts within each column are arranged such that one of the corners of each signal contact are positioned closer to the signal contacts in an adjacent column than portions of either the broadside surfaces or the edgeside surfaces of such signal contact in the adjacent column.

In a further embodiment, an orthogonal connector assembly is provided that includes a housing having a mating interface configured for engagement with a mating connector assembly and a plurality of contact modules held by the housing. The contact modules each have a contact module body and a plurality of signal contacts held by the body. Each signal contact has an encased portion encased within the contact module body and extending along a conductor plane. The signal contact has a mating portion extending from an edge of the contact module body, where the mating portion is configured to engage a signal contact of the mating connector assembly. The mating portion has opposed broadside surfaces and opposed edgeside surfaces extending between the broadside surfaces. The mating portion is oriented such that the broadside surfaces are angled transverse to the conductor plane.

DETAILED DESCRIPTION OF THE INVENTION

Figure 1:
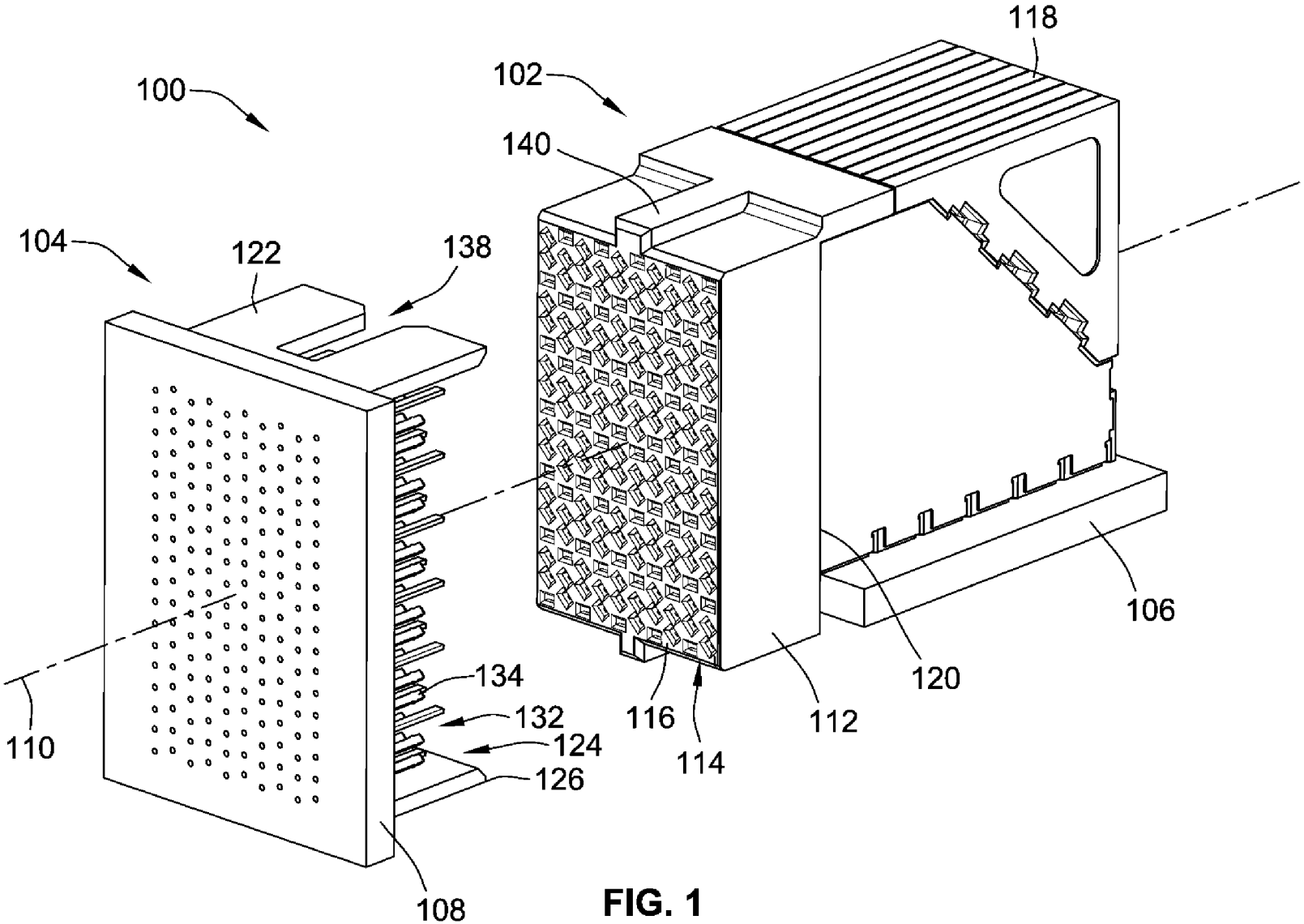
FIG. 1 is a perspective view of an orthogonal connector system formed in accordance with an exemplary embodiment illustrating a receptacle assembly and a header assembly in unmated positions.

FIG. 1 is a perspective view of an orthogonal connector system 100 formed in accordance with an exemplary embodiment illustrating two connector assemblies 102, 104 in an unmated position prior to mating with one another. The connector assemblies 102, 104 are each directly connected to first and second circuit boards 106, 108, respectively. The connector assemblies 102, 104 are utilized to electrically connect the first and second circuit boards 106, 108 to one another.

The first and second circuit boards 106, 108 are orthogonal to one another. A mating axis 110 extends through both the first and second connector assemblies 102, 104 and the first and second connector assemblies 102, 104 are mated with one another in a direction parallel to and along the mating axis 110. In an exemplary embodiment, the first circuit board 106 extends generally parallel to the mating axis 110 and the second circuit board 108 extends generally perpendicular to the mating axis 110.

In the illustrated embodiment, the first connector assembly 102 constitutes a receptacle assembly, and may be referred to hereinafter as receptacle assembly 102. The second connector assembly 104 constitutes a header assembly, and may be referred to hereinafter as header assembly 104. The receptacle assembly 102 is configured for mating with the header assembly 104.

It is realized that in alternative embodiments the receptacle assembly 102 and header assembly 104 may be interchanged such that the receptacle assembly 102 may be mounted to the second circuit board 108 and the header assembly 104 may be mounted to the first circuit board 106. It is also realized that different types of electrical connectors may be utilized to electrically connect the first and second circuit boards 106, 108. The different types of electrical connectors may have different shapes, form factors, mating interfaces, contact arrangements, contact types and the like in alternative embodiments. The receptacle assembly 102 and header assembly 104 are merely illustrative of an exemplary embodiment of the orthogonal connector system 100.

The receptacle assembly 102 includes a housing 112 having a mating face 114 at a front 116 of the housing 112. A plurality of contact modules 118 are held by the housing 112. The contact modules 118 are loaded through a rear 120 of the housing 112. The contact modules 118 are electrically connected to the first circuit board 106. The mating face 114 is oriented orthogonal with respect to the first circuit board 106 and the mating axis 110.

The header assembly 104 includes a housing 122 having a mating face 124 at a front 126 of the housing 122. The housing 122 includes a chamber 132 that receives at least a portion of the receptacle assembly 102. An array of signal contacts 134 is arranged within the chamber 132 for mating with corresponding signal contacts 136 (shown in FIG. 3) of the receptacle assembly 102. The signal contacts 134 are held by the housing 122 and extend along the mating axis 110 into the chamber 132. The signal contacts 134 are electrically connected to the second circuit board 108.

The housing 122 includes keying features 138 in the form of grooves that open at the chamber 132. The keying features 138 are configured to interact with corresponding keying features 140 on the housing 112 of the receptacle assembly 102. The keying features 140 on the housing 112 are in the form of projections that extend outward from the housing 112. The keying features 138, 140 may have different shapes or may be a different type in alternative embodiments. The keying features 138, 140 are used to orient the receptacle assembly 102 and header assembly 104 with respect to one another and/or guide the receptacle assembly 102 and/or the header assembly 104 during mating.

Figure 2:
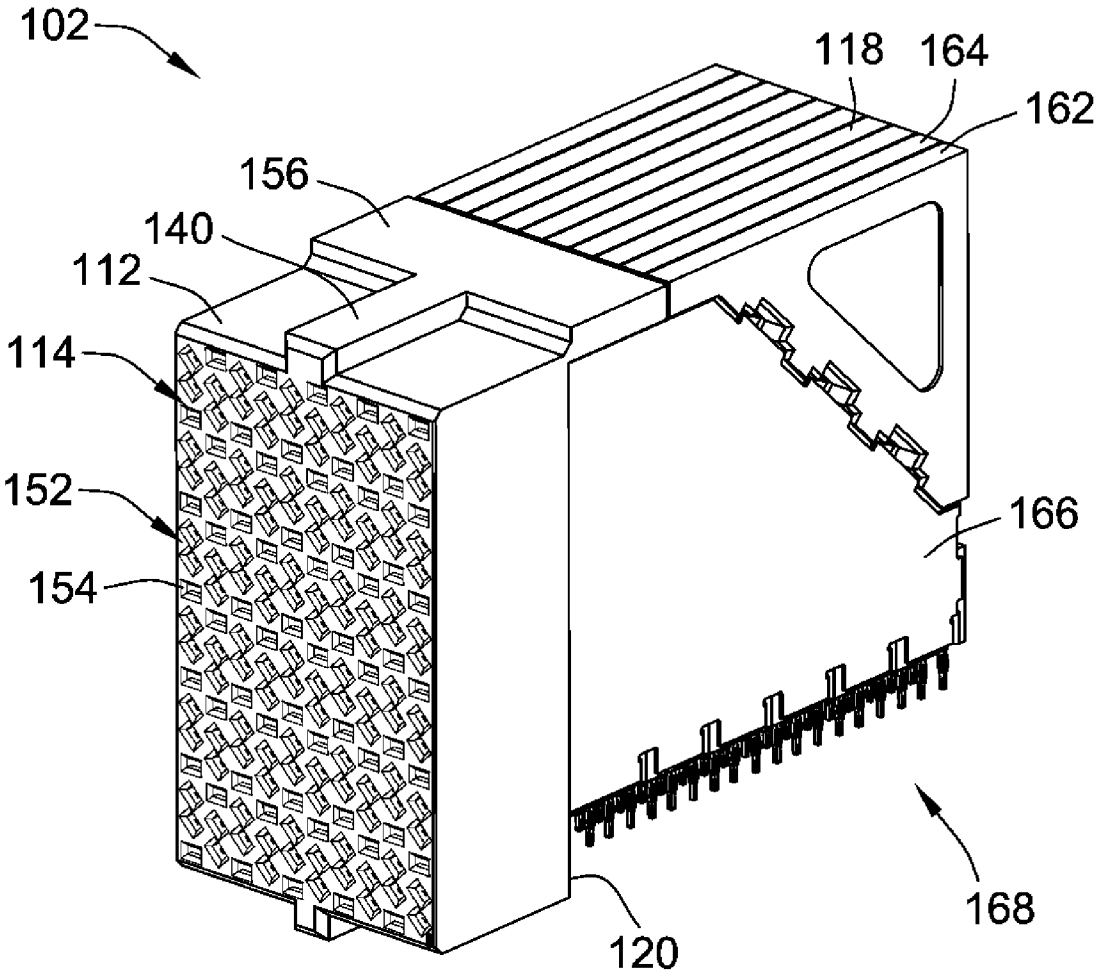
FIG. 2 is a front perspective view of the receptacle assembly shown in FIG. 1.

FIG. 2 is a front perspective view of the receptacle assembly 102 illustrating the dielectric housing 112 and the mating face 114. The housing 112 includes a plurality of contact channels 152 that are configured to receive the signal contacts 134, 136 (shown in FIGS. 1 and 3). The contact channels 152 are arranged in a pattern that complements the pattern of signal contacts 134, 136. The contact channels 152 are defined by channel walls 154. In the illustrated embodiment, the channel walls 154 define contact channels 152 that have a rectangular cross-section. The housing 112 is configured to hold the signal contacts 136 that define mating contacts for the signal contacts 134 of the header assembly 104 (shown in FIG. 1).

The housing 112 also includes an upper shroud 156 that extends rearwardly from the mating face 114. The keying features 140, in the form of guide ribs, are formed oh opposite sides of the housing 112. The housing 112 receives a plurality of the contact modules 118 holding contacts and/or conductive paths that connect the first-circuit board 106 and the header assembly 104 (shown in FIG. 1). The shroud 156 may be used to guide and/or hold the contact modules 118. The contact modules 118 are coupled to the rear 120 of the housing 112. Optionally, at least a portion of the contact modules 118 may be loaded into the rear 120 and secured thereto.

In an exemplary embodiment, multiple contact modules 118 are used. The contact modules 118 may be identical to one another, or alternatively different types of contact modules 118 may be used. For example, in the illustrated embodiment, two different types of contact-modules 118 are utilized, namely "A" type contact modules 162 and "B" type contact modules 164. The contact modules 162, 164 are arranged in an alternating sequence with five "A" type contact modules 162 and five "B" type modules 164. While ten contact modules 118 are illustrated, any number of contact modules 118 may be utilized. Additionally, more than two types of contact modules 118 may be used, and the different types of contact modules 118 may be used in any order depending oh the particular application.

A shield 166 may be coupled to corresponding contact modules 118. The shield 166 may be provided to enhance electrical performance of the receptacle assembly 102. The shield 166 may be grounded to the first circuit board 106 (shown in FIG. 1), the contact modules 118 and/or the header assembly 104 (shown in FIG. 1). Optionally, each contact module 118 may include a corresponding shield 166. The shields 166 may be identical to one another, or alternatively may be specific to the type of contact module 118 used.

The receptacle assembly 102 defines a mounting face 168 for interfacing with the first circuit board 106. The mounting face 168 is generally orthogonal to the mating face 114 such that the receptacle assembly 102 interconnects electrical components that are substantially at a fight angle to each other.

Figure 3:
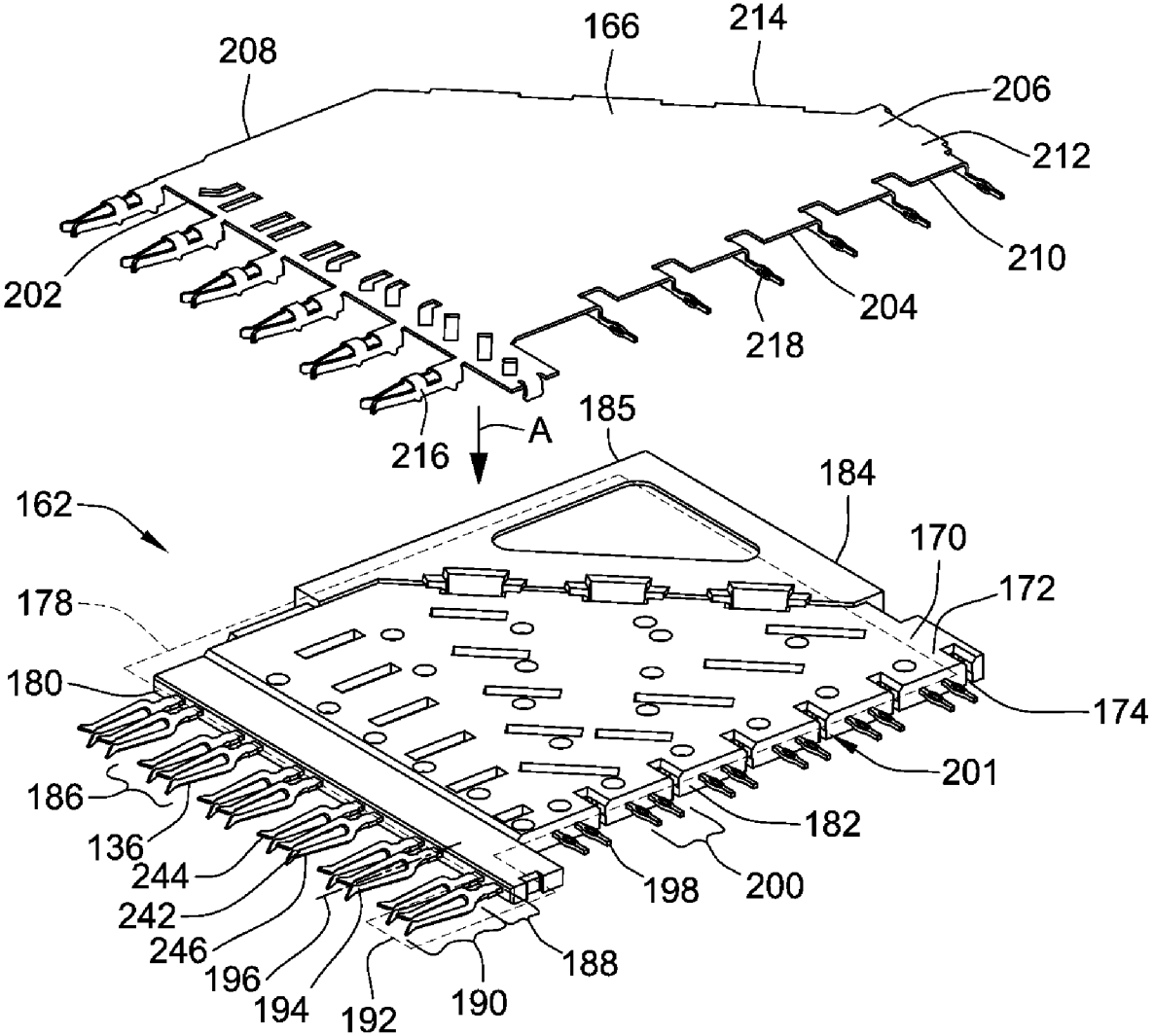
FIG. 3 is an exploded perspective view of a contact module and the shield for use with the receptacle assembly shown in FIG. 1.
Figure 5:
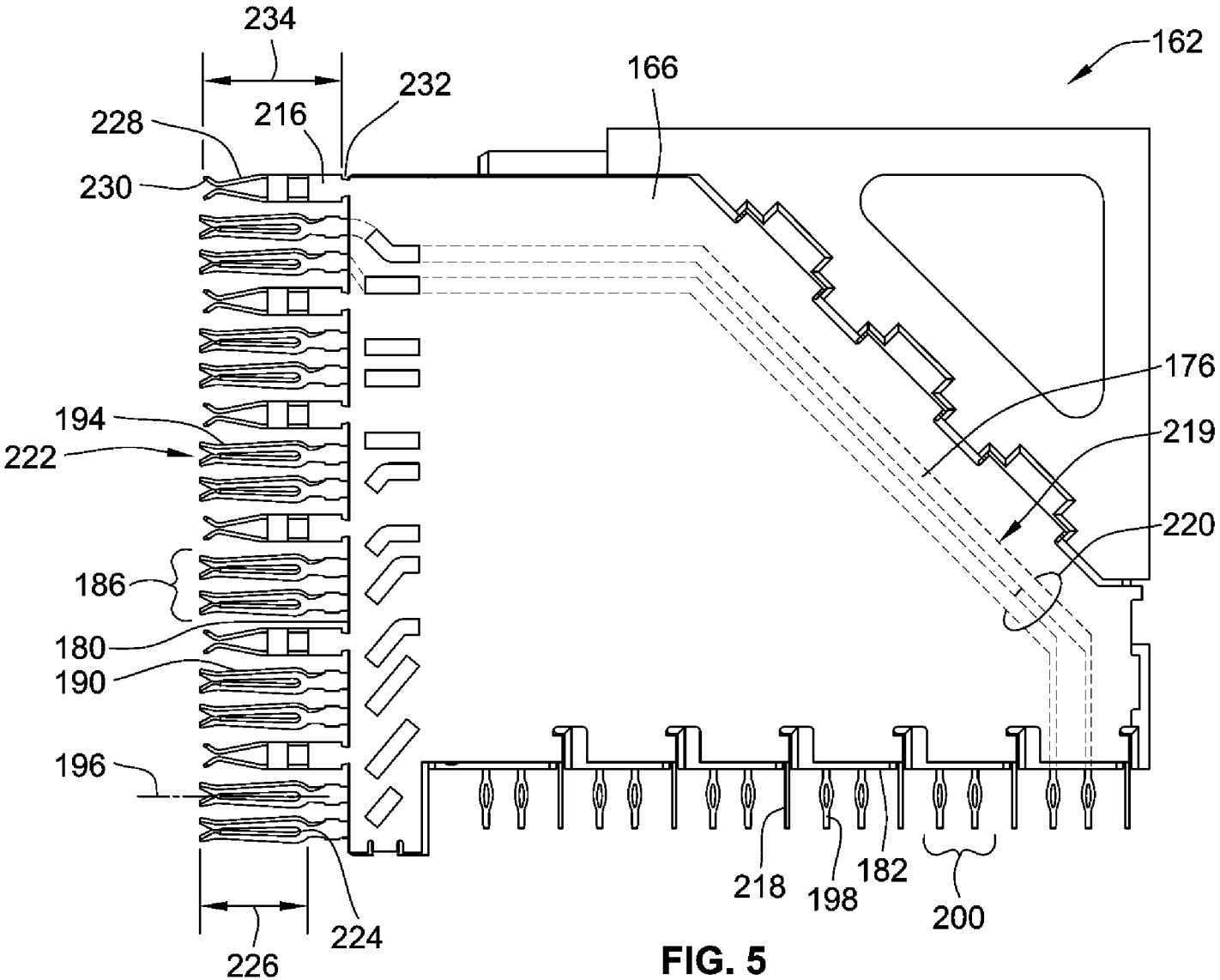
FIG. 5 is a side view of the first type of contact module for use with the receptacle assembly shown in FIG. 1.

FIG. 3 is an exploded perspective view of an "A" type of contact module 162 and the shield 166 for use with the receptacle assembly 102 (shown in FIG. 1). The contact module 162 includes a contact module body 170 having opposed sides 172, 174. The contact module body 170 holds the signal contacts 136. The signal contacts 136 include a plurality of conductors 176, which are schematically illustrated in FIG. 5, that represent encased portions of the signal contacts 136 that are held within and encased by the contact module body 170. The signal contacts 136 also include mating portions 190 that extend from the contact module body 170 and contact tails 198 that extend from the contact module body 170. The mating portions 190 and contact tails 198 are electrically connected to the conductors 176, and may be integrally formed with the conductors 176, as in the illustrated embodiment.

In an exemplary embodiment, the conductors 176 are formed from a lead frame 177 (shown in FIG. 4) and the contact module body 170 is overmolded around the lead frame 177. Alternatively, individual signal contacts, such as stamped and formed contacts, are separately positioned within the contact module body 170.

The conductors 176 extend along and define a conductor plane 178 within the contact module body 170. The conductor plane 178 extends parallel to the sides 172, 174 of the contact module body 170. Optionally, the conductor plane 178 may be substantially centered between the sides 172, 174.

The contact module body 170 includes a forward mating edge 180 and a bottom mounting edge 182 that is orthogonal to the mating edge 180. The contact module body 170 also includes a rear edge 184 opposite the mating edge 180 and a top edge 185 opposite the mounting edge 182.

The conductors 176 generally extend between the mating edge 180 and the mounting edge 182 along the conductor plane 178. The mating portions 190 are electrically connected to corresponding conductors 176 and extend through the mating edge 180. Optionally, the mating portions 190 may be integrally formed with the conductors 176 as part of the lead frame 177. The signal contacts 136 are configured to carry data signals. In alternative embodiments, other types of contacts may be provided in addition to, or in the alternative to, the signal contacts 136, such as ground contacts, power contacts, and the like. The signal contacts 136 may be arranged in pairs 186 and the signal contacts 136 may carry differential pair signals. Optionally, the signal contacts 136 within each pair 186 may be positioned closer to one another than to signal contacts 136 of another pair 186. Such an arrangement may more closely couple the signal contacts 136 within the pair 186 to one another than to signal contacts 136 of another pair 186. The contact module 162 has more than one pair of signal contacts 136.

The mating portions 190 of the signal contacts 136 are arranged in a predetermined pattern. The pattern complements the arrangement of the signal contacts 134 of the header assembly 104 such that the signal contacts 134, 136 may be electrically connected to one another. As described above, different types of contact modules 162 may have mating portions 190 arranged differently. For example, the "B" type contact modules 164 (shown in FIG. 6) may have a different arrangement of mating portions 190 than the "A" type contact module 162 illustrated in FIG. 3. In the illustrated embodiment, the mating portions 190 are shifted downward towards the bottom of the mating edge 180 of the contact module body 170 such that the mating portions 190 are closer to the bottom of the mating edge 180 than the top of the mating edge 180. The mating portions 190 are spaced apart from the top of the mating edge 180 by a greater distance than the mating portions 190 are spaced from the bottom.

In an exemplary embodiment, the signal contacts 136 include a transition portion 188 forward of the mating edge 180 of the contact module body 170. The signal contacts 136 include the mating portion 190 forward of the transition portion 188. Each mating portion 190 is configured for mating engagement with the mating contacts 134 (shown in FIG. 1) of the header assembly 104 (shown in FIG. 1).

The mating portion 190 includes broadside surfaces 242 and edgeside surfaces 244. The broadside surfaces 242 are generally larger than the edgeside surfaces 244. In an exemplary embodiment, the mating portion 190 is generally planar and defines a mating plane 192. In the illustrated embodiment, the signal contacts 136 are tuning-fork style contacts with the mating portion 190 having a pair of beams 194 separated by a gap. The beams 194 may be equally spaced apart from a mating axis 196 along which the corresponding signal contact 134 (shown in FIG. 1) of the header assembly 104 mates with the mating contact 136. Other types or styles of contacts may be provided; in alternative embodiments for mating with the signal contacts 134 of the header assembly 104.

The transition portion 188 transitions the signal contact 136 such that the mating portion 190 is non-coplanar with the conductor plane 178. In an exemplary embodiment, the transition portion 188 rotates or twists the mating portion 190 about the mating axis 196 such that the mating plane 192 is transverse to the conductor plane 178. Optionally, the mating portions 190 may be twisted to approximately a 45° angle with respect to the conductor 176 adjacent the mating portion 190. The mating portions 190 are positioned such that the broadside surfaces 242 are angled with respect to the conductor plane 178. The mating portions 190 are positioned such that the edgeside surfaces 244 are angled with respect to the conductor plane 178. The broadside surfaces 242 and the edgeside surfaces 244 meet at and define a corner 246. The corners 246 may be non-coplanar with the conductor plane 178. Edgeside surfaces 244 of immediately adjacent signal contacts 136 are not aligned with each other. In an exemplary embodiment, edgeside surfaces 244 of immediately adjacent signal contacts 136 are offset from each other on respective opposite sides of the conductor plane 178.

The contact module 118 includes a plurality of contact tails 198. The contact tails 198 are electrically connected to corresponding conductors 176 and extend through the mounting edge 182. Optionally, the contact tails 198 may be integrally formed with the conductors 176 as part of the lead frame 177. The contact tails 198 may be signal contacts, ground contacts, power contacts and the like. In the illustrated embodiment, the contact tails 198 are signal contacts configured to carry data signals. The contact tails 198 may be arranged in pairs 200 and the contact tails 198 may carry differential pair signals. Optionally, the contact tails 198 within each pair 200 may be positioned closer to one another than to contact tails 198 of a different pair 200. Such an arrangement may more closely couple the contact tails 198 within the pair 200 to one another than to contact tails 198 of another pair 200. The contact module 162 has more than one pair of contact tails 198. In an exemplary embodiment, the contact tails 198 are generally coplanar with the conductor plane 178. The contact tails 198 may be eye-of-the-needle type contacts that fit into vias in the circuit board 106 (shown in FIG. 1). Other types of contacts may be used for through hole mounting or surface mounting to the circuit board 106. In an exemplary embodiment, the contact module body 170 includes slots 201 at the mounting edge 182 between the pairs 200 of contact tails 198.

The shield 166 is configured to be coupled to the contact module 162. The shield 166 may be designed specifically for a particular type of contact module, such as the "A" type contact module 162, and may not be used with other types of contact modules, such as the "B" type contact module 164 (shown in FIGS. 2 and 6). However, the shield 166 may be designed to be used with more than one type of contact module 162 or 164 in alternative embodiments.

The shield 166 includes a forward mating edge 202 and a bottom mounting edge 204 that is orthogonal to the mating edge 202. The shield 166 also includes a rear edge 206 opposite the mating edge 202 and a top edge 208 opposite the mounting edge 204. The shield 166 has an inner side 210 and an outer side 212. When mounted to the contact module 162, the inner side 210 generally, faces the contact module 162 and the outer side 212 generally faces away from the contact module 162. A plurality of mounting tabs 214 may extend inwardly for connecting the shield 166 to the contact module 162.

In an exemplary embodiment, the shield 166 includes shield mating contacts 216 that extend forward from the mating edge 202. The shield mating contacts 216 extend into corresponding contact channels 152 (shown in FIG. 2) for mating engagement with corresponding shield mating contacts, ground contacts or ground pins of the header assembly 104 (shown in FIG. 1). The bulk of each shield mating contact 216 is positioned inward with respect to the shield 166, such as in the direction shown by arrow A, which is generally towards the contact module 162 when the shield 166 is coupled to the contact module 162.

The shield mating contacts 216 are arranged along the mating edge 202 in a predetermined pattern. In the illustrated embodiment, the shield mating contacts 216 are equally spaced apart from one another. The shield mating contacts 216 are shifted upward towards the top edge 208 such that the shield mating contacts 216 are more closely positioned to the top of the mating edge 202 than the bottom of the mating edge 202.

The shield 166 includes shield tails 218 that extend downward and inward from the mounting edge 204. The shield tails 218 may include one or more eye-of-the-needle type contacts that fit into vias in the circuit board 106. Other types of contacts may be used for through hole mounting or surface mounting to the circuit board 106. The bulk of each shield tail 218 is positioned inward with respect to the shield 166, such as in the direction shown by arrow A, which is generally towards the contact module 162 when the shield 166 is coupled to the contact module 162. The shield tails 218 are configured to fit in the slots 201 formed in the contact module body 170.

The shield tails 218 are arranged along the mounting edge 204 in a predetermined pattern. In the illustrated embodiment, the shield tails 218 are equally spaced apart from one another. The shield tails 218 are shifted rearward towards the rear edge 206 such that the shield tails 218 are more closely positioned to the rear of the mounting edge 204 than the front of the mounting edge 204.

Figure 4:
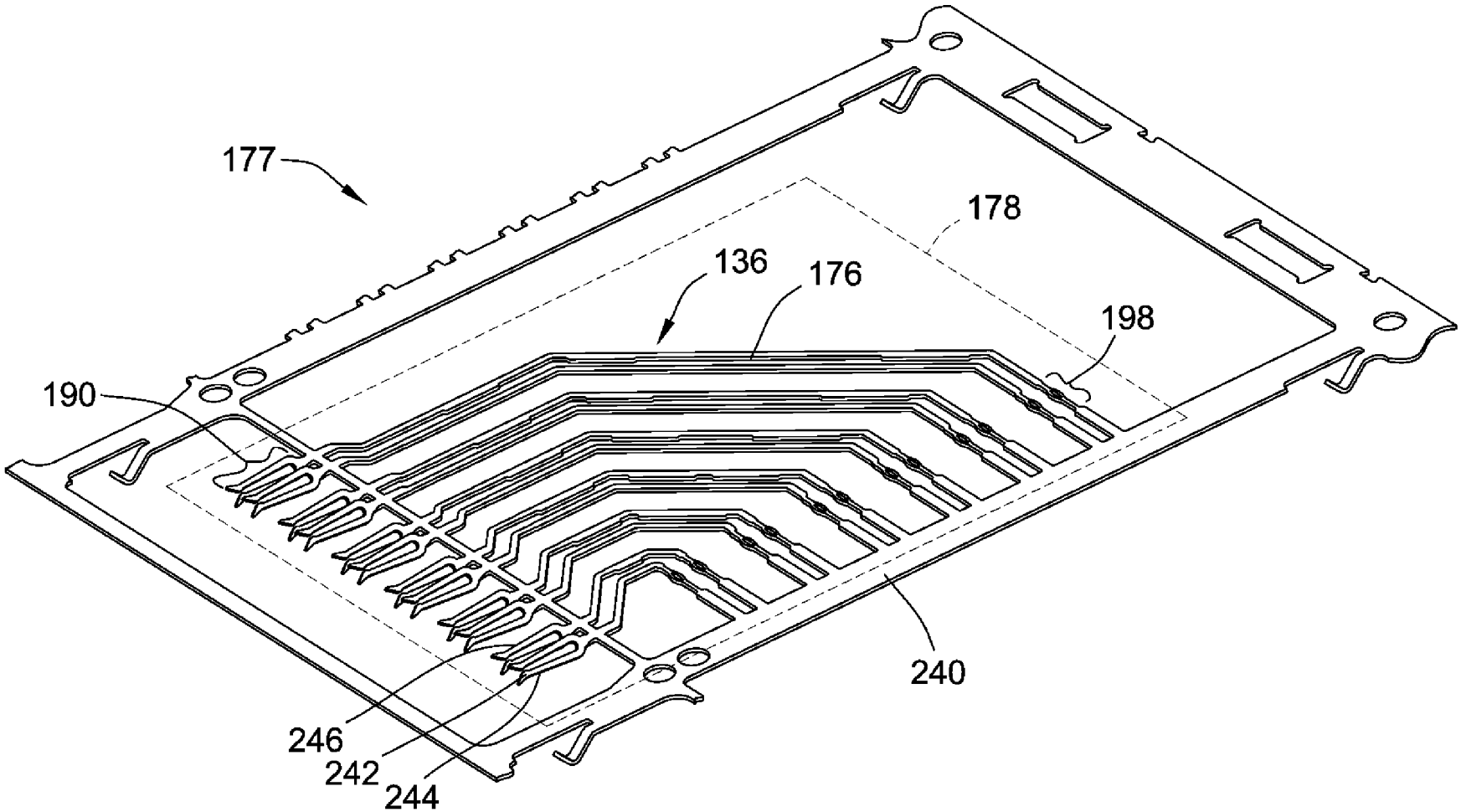
FIG. 4 illustrates a lead frame that forms part of the contact module shown in FIG. 3.

FIG. 4 illustrates the lead frame 177 that forms part of the contact module 162 (shown in FIG. 3). The lead frame 177 includes the signal contacts 136 with the conductors 176, mating portions 190 and contact tails 198 arranged in a predetermined pattern. The lead frame 177 is held by a carrier strip 240 that is used during manufacture to hold the conductors 176, mating portions 190 and contact tails 198, but is ultimately removed, such as after overmolding the contact module body 170 (shown in FIG. 3) over select portions of the lead frame 177.

The lead frame 177 and carrier strip 240 may be stamped from a blank of material to define the conductors 176, mating portions 190 and contact tails 198. The top and bottom surfaces of the blank define broadside surfaces 242 of the conductors 176, mating portions 190 and/or contact tails 198. The cut sides (i.e. the side defined by the stamping process) define edgeside surfaces 244 of the conductors 176, mating portions 190 and/or contact tails 198. The edgeside surfaces 244 of adjacent conductors 176 face one another, whereas the broadside surfaces 242 face outward and do not face one another. The broadside surfaces 242 may be wider than the edgeside surfaces 244.

Prior to removing the carrier strip 240, the mating portions 190 may be bent or formed, such as by twisting the mating portions 190 to a desired position. Once twisted, the broadside surfaces 242 of the mating portions 190 are no longer coplanar with the broadside surfaces 242 of the other portions of the conductors 176. Similarly, the edgeside surfaces 244 are no longer coplanar with the immediately adjacent portions of the conductors 176 that are encased in the contact module body 170. Rather, the mating portions 190 are angled out of plane with respect to the conductor plane 178. In alternative embodiments, the twisting may be done after the carrier strip 240 is removed and after the contact module body 170 is overmolded. Optionally, as described in further detail below, the mating portions 190 may be twisted during loading of the contact modules 118 (shown in FIG. 1) into the housing 112 (shown in FIG. 1), such as by providing guides or lead-ins (not shown) to the contact channels 152 (shown in FIG. 2).

FIG. 5 is a side view of the contact module 162 with the shield 166 connected thereto. The conductors 176 are shown in phantom between the mating portions 190 and the contact tails 198. The conductors 176 are right angle conductors that include transition sections 219 that change the direction of the conductors 176 by approximately 90°. The contact tails 198 extend from the mounting edge 182 in a first direction and the mating portions 190 extend from the mating edge 180 in a second direction that is generally perpendicular with respect to the first direction. The transition sections 219 transition the conductors 176 from extending generally along the first direction to generally along the second direction. In the illustrated embodiment, the conductors 176 represent signal conductors that carry data signals between the mating portions 190 and the contact tails 198. No ground or power conductors are provided, however in alternative embodiments, the conductors 176 may be signal conductors, ground conductors, power conductors and the like depending on the particular application. The conductors 176 are arranged in pairs 220, where the conductors 176 within each pair 220 may be positioned closer to one another than to conductors 176 of another pair 220. Such an arrangement may more closely couple the conductors 176 within the pair 220 to one another than to other adjacent conductors 176 of another pair 220. The contact module 162 has more than one pair of conductors 176.

When the shield 166 is coupled to the contact module 162, the shield mating contacts 216 extend forward of the mating edge 180 of the contact module 162. Additionally, the shield tails 218 extend downward from the mounting edge 182 of the contact module 162. The pattern of mating portions 190 and shield mating contacts 216 complement one another such that the shield mating contacts 216 are positioned between adjacent pairs 186 of mating portions 190. The contact module 162 and the shield 166 have a repeating signal-signal-ground contact pattern from the bottom of the mating edge 180 to the top of the mating edge 180. The pattern of contact tails 198 and shield tails 218 complement one another such that the shield tails 218 are positioned between adjacent pairs 200 of contact tails 198. The contact module 162 and the shield 166 have a repeating signal-signal-ground contact pattern from the front of the mounting edge 182 to the rear of the mounting edge 182 (from left to right as viewed in FIG. 5).

The mating portions 190 include the opposed beams 194 that are separated by a gap 222 that receives a corresponding signal contact 134 of the header assembly 104 (shown in FIG. 1). The beams 194 are provided on opposite sides of the mating axis 196, and the signal contact 134 is received along the mating axis 196. The gap 222 has a closed end 224 at the rear of the gap 222. The gap 222 has a length 226 measured between the open end of the signal contact 136 and the closed end 224. The mating portions 190 are twisted about the mating axis 196 such that the mating portions 190 are not oriented vertically, but rather are angled out of the vertical plane.

The shield mating contacts 216 include opposed fingers 228 that extend between a front 230 and a rear 232. The fingers 228 may be separated from one another between the front 230 and the rear 232 such that the shield mating contacts 216 are configured to mate with a shield mating contact, a ground contact or a ground pin along an entire length 234 of the shield mating contacts 216. The shield mating contacts 216 may connect with shield mating contacts, ground contacts or ground pins that are longer than the signal contacts 134 that connect with the signal contacts 136. The shield mating contacts 216 do not include a closed end similar to the closed end 224 such that the contacts mated with the shield mating contacts 216 do not have the potential of bottoming out against a closed end.

Figure 6:
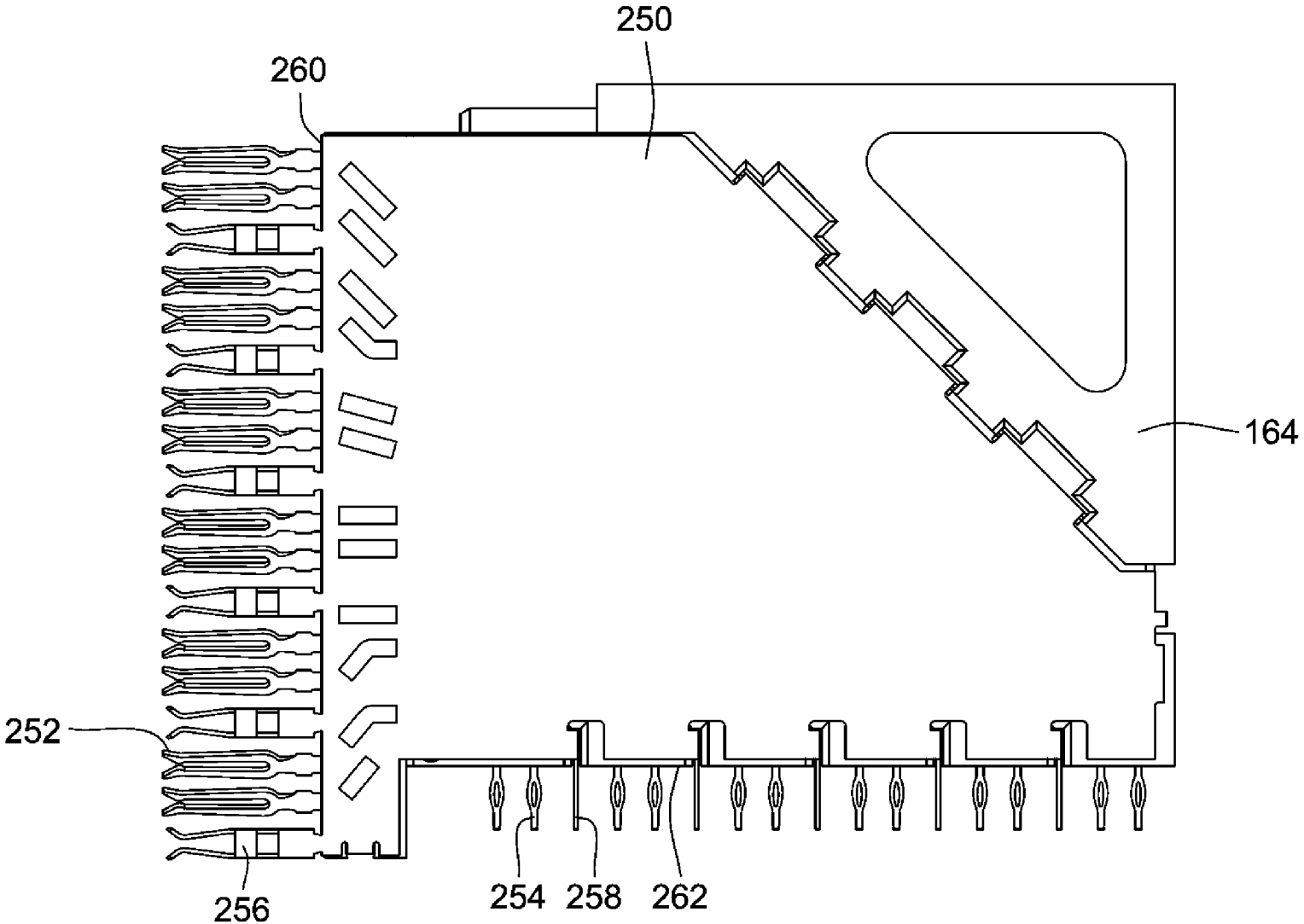
FIG. 6 is a side view of the second type of contact module for use with the receptacle assembly shown in FIG. 1.

FIG. 6 is a side view of the type "B" contact module 164 and a shield 250 for the receptacle assembly 102 (shown in FIG. 3). The contact module 164 may be substantially similar to the contact module 162 (shown in FIG. 3), however the arrangement and pattern of mating portions 252 and contact tails 254 may be different than the arrangement and pattern of mating portions 190 (shown in FIG. 3) and contact tails 198 (shown in FIG. 3). Similarly, the shield 250 may be substantially similar to the shield 166 (shown in FIG. 3), however the arrangement and pattern of shield mating contacts 256 and shield tails 258 may be different than the arrangement and pattern of shield mating contacts 216 (shown in FIG. 3) and shield tails 218 (shown in FIG. 3).

The shield 250 is coupled to the contact module 164 such that the shield mating contacts 256 are arranged between adjacent pairs of mating portions 252 and such that the shield tails 258 are arranged between adjacent pairs of contact tails 254. The mating portions 252 and the shield mating contacts 256 have a repeating ground-signal-signal contact pattern from a bottom of a mating edge 260 to a top of the mating edge 260, which is different than the signal-signal-ground contact pattern of the type "A" contact module 162. The contact tails 254 and the shield tails 258 have a repeating ground-signal-signal contact pattern from a front of a mounting edge 262 to a rear of the mounting edge 262 (viewed from left to right in FIG. 6), which is different than the signal-signal-ground contact pattern of the type "A" contact module 162.

When the receptacle assembly 102 is assembled, the contact modules 162, 164 are positioned adjacent one another. The different contact patterns of the contact modules 162, 164 stagger at least some portions of the signal paths (e.g. the signal path may be defined by the mating portion, the conductor and/or the contact tail) such that one or more signal paths within the contact module 164 are misaligned or not aligned with a signal path of an adjacent contact module 162. The overall electrical performance of the receptacle assembly 102, which utilizes two types of contact modules 162, 164, may be enhanced as compared to a receptacle assembly that utilizes contact modules that are identical.

Figure 7:
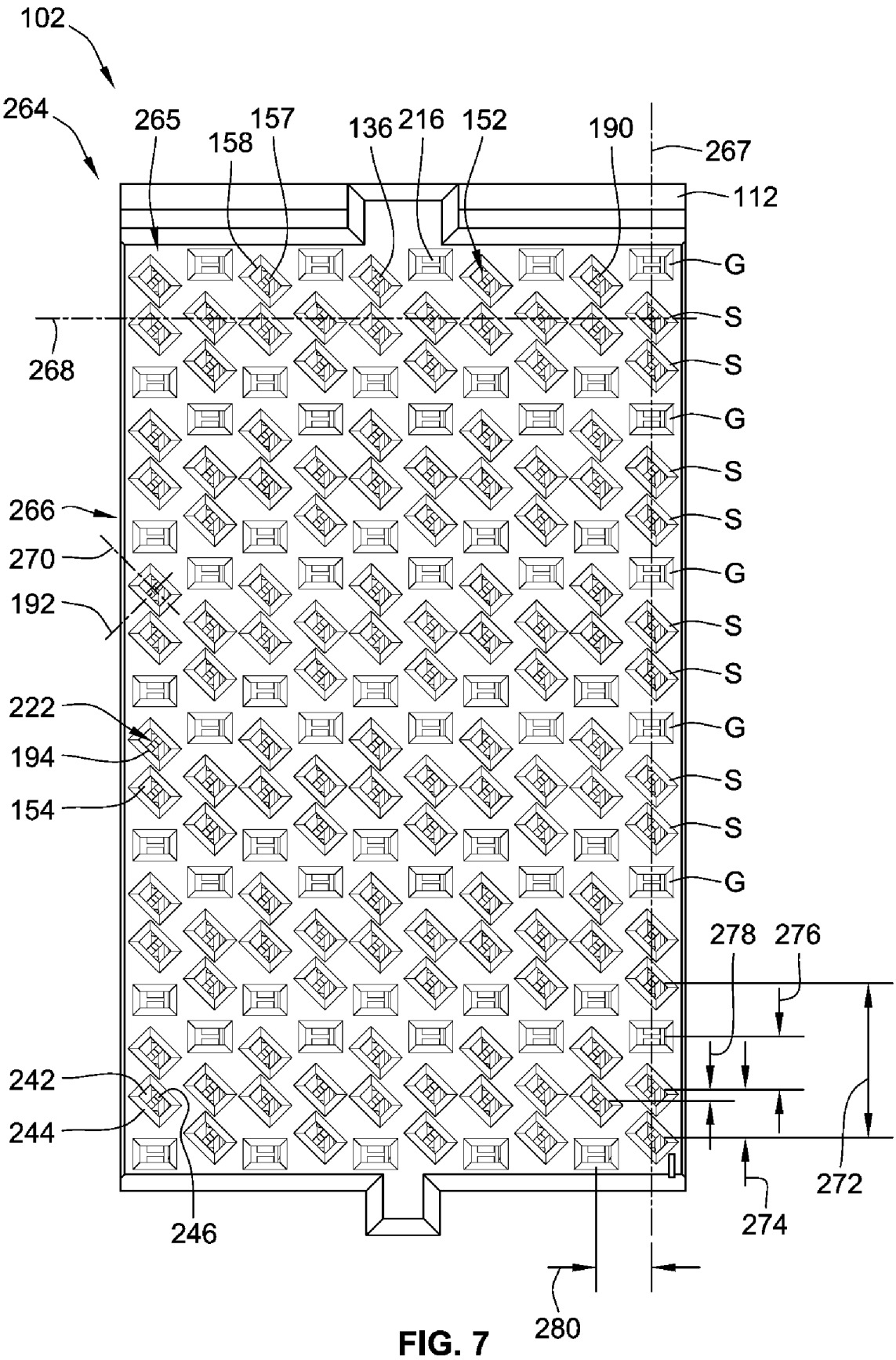
FIG. 7 is a front view of the receptacle assembly shown in FIG. 2.

FIG. 7 is a front view of the receptacle assembly 102 illustrating a mating interface 264 thereof. FIG. 7 illustrates the signal contacts 136 and shield mating contacts 216 within the contact channels 152. The signal contacts 136 and shield mating contacts 216 are arranged in columns 265 and rows 266. The signal contacts 136 and shield mating contacts 216 are arranged vertically along a column axis 267 (one of which is shown in FIG. 7). Additionally, the signal contacts 136 and shield mating contacts 216 are arranged horizontally along a row axis 268 (one of which is shown in FIG. 7), which is generally perpendicular to the column axis 267. The column axis 267 is parallel to the sides of the housing 112 and the row axis 268 is parallel to the top and bottom of the housing 112.

The signal contacts 136 and the shield mating contacts 216 of the contact module 118 within the right-most column are identified and labeled with signal S and ground G labels, respectively. FIG. 7 illustrates the orientation of the mating portions 190 of the signal contacts 136 with respect to the column axes 267 and the row axes 268. The mating portions 190 are non-orthogonal (i.e. non-parallel and non-perpendicular) to the row axes 268 and the column axes 267. The mating portions 190 of a set of the signal contacts 136 within each row 266 have mating planes 192 oriented parallel to one another. The mating planes 192 of the mating portions 190 within the row 266 are oriented at an acute angle with respect to the row axes 268.

The broadside surfaces 242 of the mating portions 190 and the edgeside surfaces 244 of the mating portions 190 are angled with respect to the column axes 267 and the row axes 268. In the illustrated embodiment, the broadside surfaces 242 and the edgeside surfaces 244 are angled at approximately a 45° angle with respect to the column and row axes 267, 268. As such, the surfaces of the mating portions 190 do not directly face the adjacent column or row axes 267, 268. Rather the surfaces of the mating portions 190 face in a direction that is transverse or at an angle to the column or row axes 267, 268. In some embodiments, the mating portions 190 may be angled at an angle such that the mating portions 190 do not directly face signal contacts 136 and/or shield mating contacts 216 in the adjacent columns 265. The corners 246 of the mating portions 190 are the closest part of the mating portions 190 to the adjacent column and/or row axes 267, 268. The corners 246 may be the closest part of the mating portions 190 to the signal contacts 136 and/or shield mating contacts 216 in the adjacent columns 265. As such, the mating portions 190 are neither directly broadside coupled nor directly edgeside coupled to adjacent signal contacts 136 and/or shield mating contacts 216 in the adjacent columns 265. As such, the amount of coupling and/or interaction with adjacent signal contacts 136 may be different as compared to situations in which the signal contacts 136 directly face one another. Because broadside coupling between signal contacts 136 in adjacent columns 265 may be reduced, the amount of overall coupling therebetween may also be reduced. Less signal degradation may result from twisting the mating portions 190 such that the mating portions 190 do not directly face signal contacts 136 in adjacent columns 265. Because less signal degradation is experienced between the mating portions 190, the columns 265 of signal contacts 136 may be more closely spaced, while still having similar performance levels as compared to connector assemblies that do not have mating portions 190 that are angled non-orthogonal with respect to the column axes 265, such as with the connector assembly shown in FIG. 8.

The orientation of the contact channels 152 with respect to the column axes 267 and the row axes 268 is also illustrated in FIG. 7. The channel walls 154 lie transverse to the row axes 268 and the column axes 267. For example, the channel walls 154 include both broadside channel walls 157 and edgeside channel walls 158. The broadside channel walls 157 and the edgeside channel walls 158 are angled with respect to the column axes 267 and the row axes 268. In the illustrated embodiment, the broadside channel walls 157 are perpendicular to the broadside surfaces 242 and the edgeside channel walls 158 are perpendicular to the edgeside surfaces 244. The channel walls 154 define an opening that is configured to receive the signal contacts 134 of the header-assembly 104. The channel walls 154 guide the signal contacts 134 into engagement with the signal contacts 136. In particular, the signal contacts 134 are guided into the gap 222 between the beams 194 of the mating portion 190. The signal contacts 134 are oriented along receptacle contact planes 270 that are perpendicular to the mating planes 192.

The receptacle assembly 102 has an inter-pair pitch 272 between adjacent pairs 186 of signal contacts 136 within a column 265. In one exemplary embodiment, the inter-pair pitch 272 may be 4.2 mm, however other pitches are possible in alternative embodiments. The receptacle assembly 102 has an intra-pair pitch 274 between the signal contacts 136 within each pair 186. In one exemplary embodiment, the intra-pair pitch 274 may be 1.3 mm, however other pitches are possible in alternative embodiments. The receptacle assembly 102 has a signal-ground contact pitch 276 between each signal contact 136 and an adjacent shield mating contact 216. Optionally, the signal-ground contact pitch 276 may be slightly greater than or the same as the intra-pair pitch 274. In one exemplary embodiment, the signal-ground contact pitch 276 may be 1.45 mm, however other pitches are possible in alternative embodiments. In an exemplary embodiment, the signal contacts 136 of one contact module 118 may be slightly offset with respect to the signal contacts 136 of the adjacent contact modules 118 along the contact row 266. Similarly, the signal contacts 136 of one contact module 118 may be slightly offset with respect to the shield-mating contacts 216 of the adjacent contact modules 118 along the contact row 266.

The receptacle assembly 102 has a row off-set pitch 278 between adjacent signal contacts 136 and/or shield mating contacts 216 along the contact rows 266. In one exemplary embodiment, the row off-set pitch 278 may be 0.3 mm, however other pitches are possible in alternative embodiments. The staggering of adjacent signal contacts 136 increases the distance between the signal contacts 136, which affects interactions between the signal contacts 136, such as electromagnetic, capacitive and/or inductive coupling therebetween, which affects cross-talk and other electrical characteristics that lead to signal degradation. The row-off-set pitch 278 allows closer column spacing due to the reduced coupling of the signal contacts 136, and thus greater density of the receptacle assembly 102.

The receptacle assembly 102 has a column pitch 280 between adjacent columns 265. In one exemplary embodiment, the column pitch 280 may be 1.5 mm, however other pitches are possible in alternative embodiments. The column pitch 280 affects the overall density of the receptacle assembly 102. For a given number of signal pairs within a column 265 (e.g. six signal pairs as in the illustrated embodiment), the density of the receptacle assembly 102 may be increased by decreasing the column pitch 280. The number of pairs per linear inch may be increased if the column pitch 280 is decreased.

Figure 8:
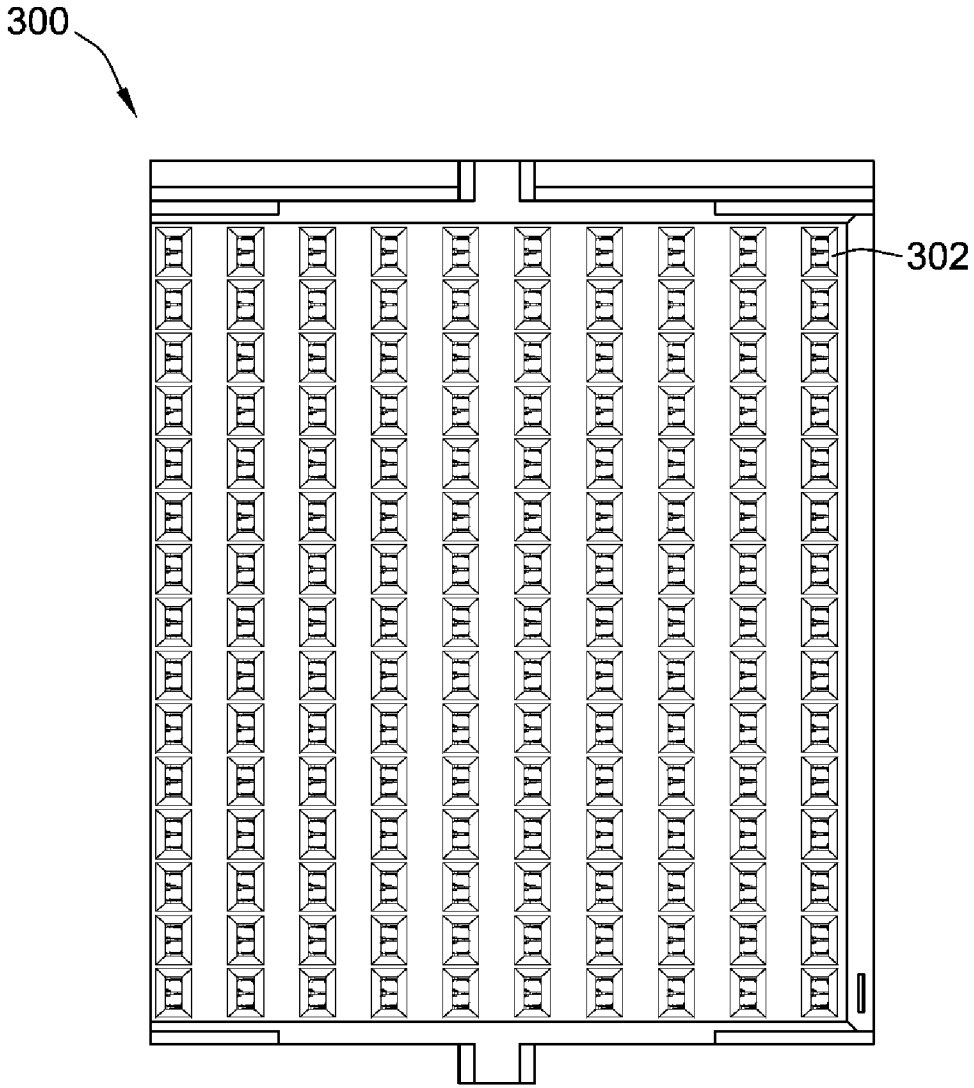
FIG. 8 is a front view of another type of receptacle assembly.

FIG. 8 is a front view of another type of receptacle assembly 300 having a plurality of signal contacts 302. The receptacle assembly 300 is similar to the receptacle assembly 102, however the receptacle assembly 300 does not include signal contacts that are oriented at an angle with respect to row and column axes. Additionally, the receptacle assembly 300 does not include signal contacts that are off-set along row axes.

The receptacle assembly 300 is operated at a predetermined electrical performance level. The interaction between the signal contacts 302 of the receptacle assembly 300 has an effect on the electrical performance level. Factors that contribute to the interaction between the signal contacts 302 of the receptacle assembly 300 include, but are not limited to, the spacing between the signal contacts of different columns, as well as the amount of broadside coupling between adjacent signal contacts 302 in different columns. The receptacle assembly 300 has a column spacing of 1.9 mm. The density of the receptacle assembly 300 is based on the column spacing and the number of signal contacts and/or pairs within the columns.

Comparing the receptacle assembly 102 to the receptacle assembly 300, the receptacle assembly 102 has a higher density. More signal contacts 136 and signal pairs are provided along the width of the receptacle assemblies 102, 300. Contributing to the increase in density of the receptacle assembly 102 are the orientation of the signal contacts 136 at an angle with respect to column and row axes 267, 268 and the positioning of the signal contacts 136 in a staggered arrangement along the row axes 268. Both features may reduce the amount of broadside coupling between the signal contacts 136 in adjacent columns 267.

Figure 9:
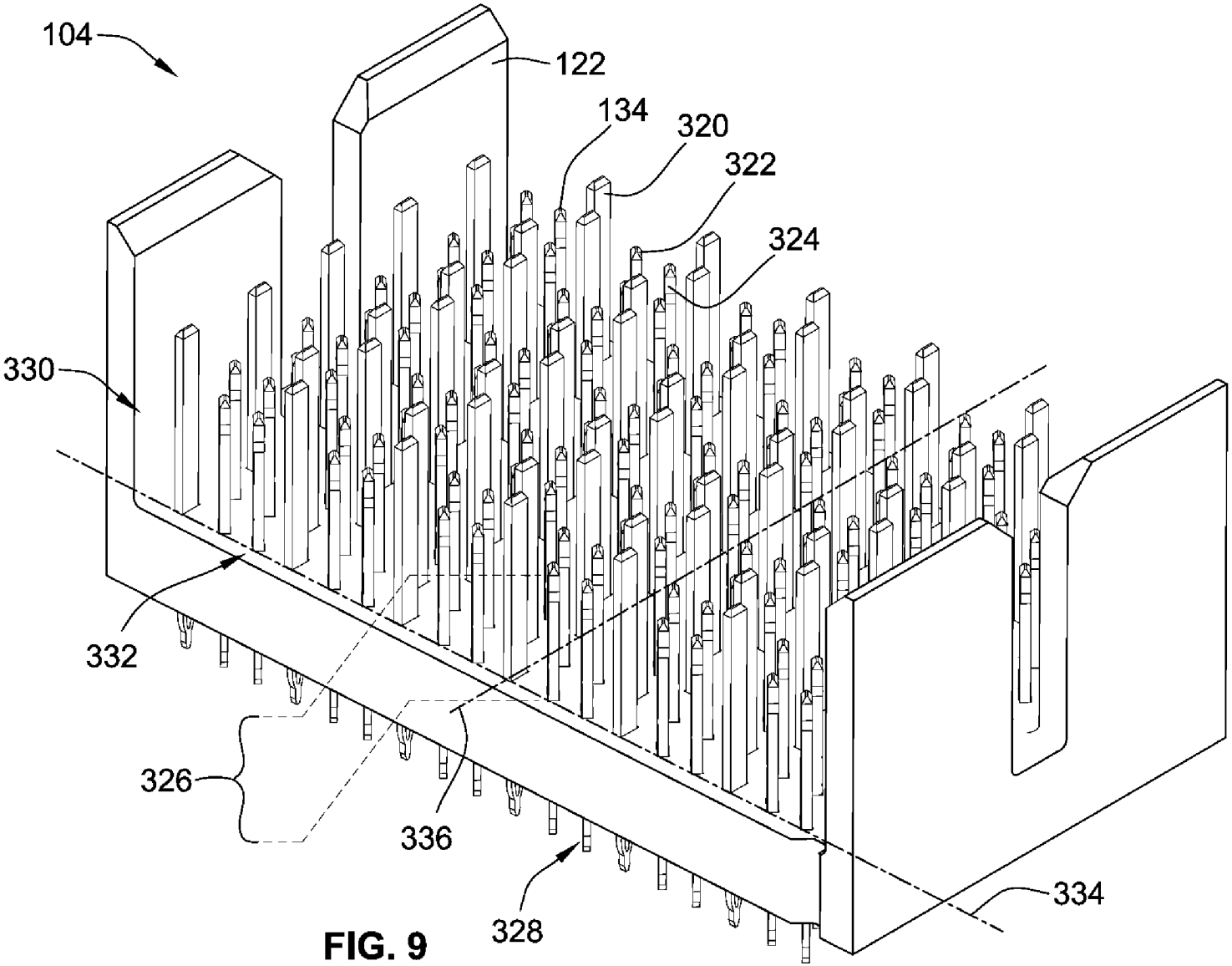
FIG. 9 is a front perspective view of the header assembly shown in FIG. 1.

FIG. 9 is a front perspective view of the header assembly shown in FIG. 1. The header assembly 104 includes the housing 122 that holds the signal contacts 134, which define mating contacts for the signal contacts 136 of the receptacle assembly 102 (shown in FIG. 3). The housing 122 also holds a plurality of ground contacts 320. The ground contacts 320 are configured to mate with the shield mating contacts 216 (shown in FIG. 3) of the receptacle assembly 102.

The signal contacts 134 are blade-type contacts having a generally rectangular cross-section. The signal contacts 134 include broadside surfaces 322 and edgeside surfaces 324 extending between the broadside surfaces 322. The edgeside surfaces 324 may be narrower than the broadside surfaces 322. The signal contacts 134 include mating portions 326 at one end thereof and mounting portions 328 at the opposite end thereof. In the illustrated embodiment, the mounting portions 328 are eye-of-the-needle type contacts, however other types are possible in alternative embodiments. The mounting portions 328 are configured to be mounted to the second circuit board 108 (shown in FIG. 1).

The signal contacts 134 are arranged in a matrix of columns 330 and rows 332. The signal contacts 134 are arranged within each column 330 along a column axis 334 (one of which is shown in FIG. 9). Additionally, the signal contacts 134 are arranged within each row 332 along a row axis 336 (one of which is shown in FIG. 9), which is generally perpendicular to the column axis 334. FIG. 9 illustrates the orientation of the signal contacts 134 with respect to the column axes 334 and the row axes 336. The signal contacts 134 are non-orthogonal to the row axes 336 and the column axes 334. The broadside surfaces 322 and the edgeside surfaces 324 are angled with respect to the column axes 334 and the row axes 336. In the illustrated embodiment, the broadside surfaces 322 and the edgeside surfaces 324 are angled at approximately a 45° angle with respect to the column and row axes 334, 336. The arrangement of the signal contacts 134 may reduce the broadside coupling between signal contacts 134 in adjacent columns 330 is reduced.

Figure 10:
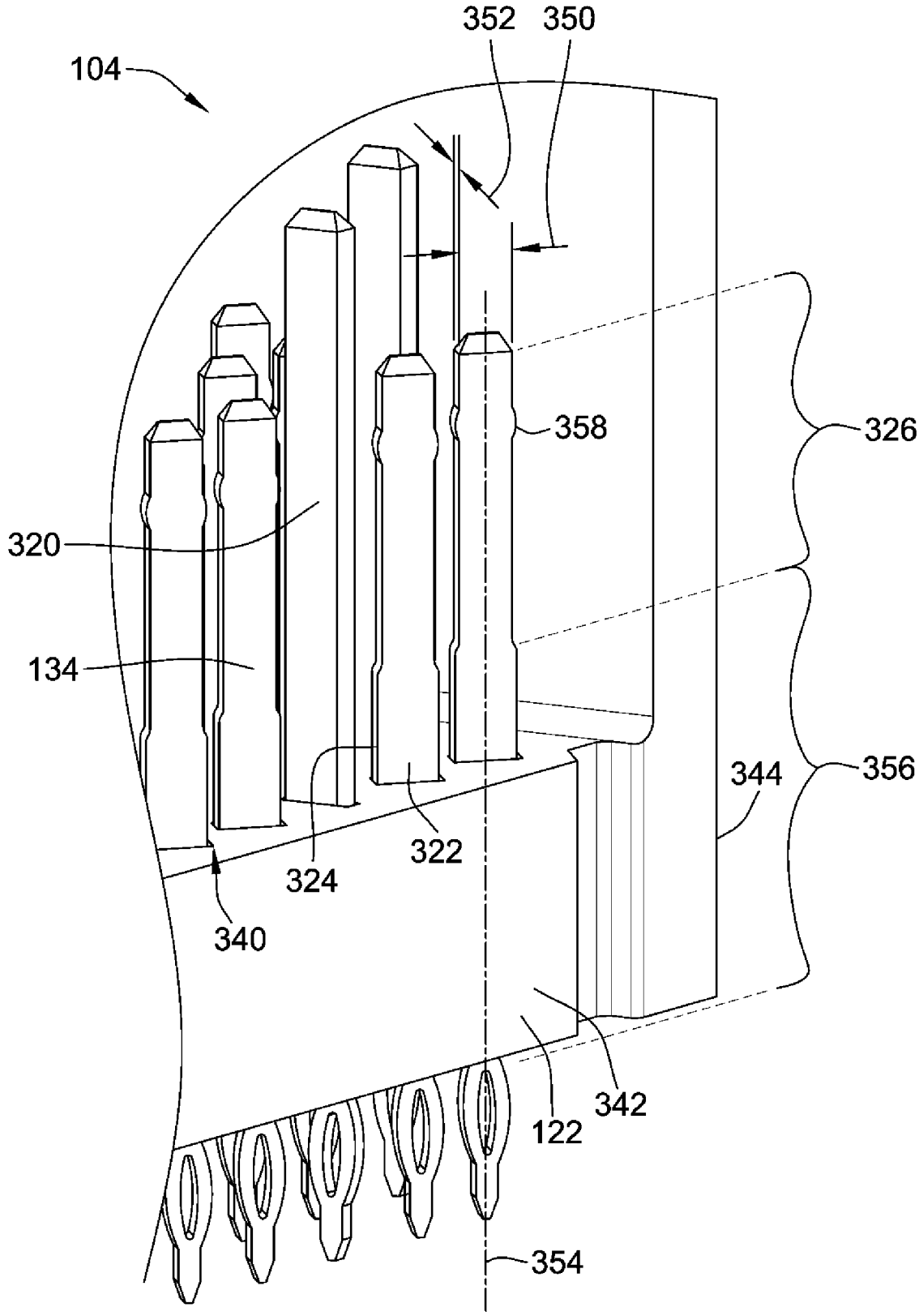
FIG. 10 is a partial side perspective view of a portion of the header assembly shown in FIG. 9.

FIG. 10 is a partial side perspective view of a portion of the header assembly 104. The header assembly housing 122 holds the signal contacts 134 and the ground contacts 320 in contact channels 340. The signal contacts 134 are blade-type contacts having a generally rectangular cross-section. The signal contacts 134 include both the broadside surfaces 322 and the edgeside surfaces 324. The signal contacts 134 are angled such that neither the broadside surfaces 322 nor the edgeside surfaces 324 directly face either side 342 or either end 344 of the housing 122. The ground contacts 320 are oriented such that broadside surfaces 346 and edgeside surfaces 348 thereof directly face the sides 342 and ends 344, respectively, of the housing 122. In an alternative embodiment, the ground contacts 320 may be angled such that the broadside and edgeside surfaces 346, 348 thereof do not directly face the sides 342 or ends 344 of the housing 122. In the illustrated embodiment, the ground contacts 320 are longer than the signal contacts 134.

The signal contacts 134 have a width 350 measured along the broadside surface 322 and a thickness 352 measured along the edgeside surface 324. The width 350 and the thickness 352 of the signal contact 134 defines a cross-sectional area. The widths 350 and/or the thicknesses 352 may be varied along a contact axis 354 of the signal contacts 134. The widths 350 and/or the thicknesses 352 may be selected to control an electrical characteristics of the signal contacts 134. For example, the widths 350 and/or the thicknesses 352 may be selected for impedance control.

In an exemplary embodiment, the mating portions 326 of the signal contacts 134 have a reduced cross-sectional area (e.g. a reduced width 350 and/or thickness 352) as compared to a base portion 356 of the signal contact 134. The base portion 356 is the portion of the signal contact 134 adjacent the mating portion 326. The base portion 356 is the portion of the signal contact 134 received in the contact channel 340. The amount of metal along any given portion of the contact axis 354 affects the impedance of the signal path. The amount of metal includes not only the metal of the signal contact 134 itself, but also the amount of metal of the signal contact 136 mated to the signal contact 134. The signal contact 136 mated with the signal contact 134 affects the impedance of the signal path at the mating interface. The mating portion 326 may have a reduced cross-section to compensate for the additional metal of the signal contact 136 along the mating portion 326. As such, the impedance value along the length of the contact axis 354 may be controlled by controlling the cross-sectional area of the signal contact 134. Reducing the cross-sectional area in the mating portion 326 aids in maintaining the impedance value at a substantially constant value along the length of the contact axis 354.

In the illustrated embodiment, each signal contacts 136 has one or more bumps 358 extending from the edgeside surfaces 348 along the mating portion 326 of the signal contact 136. The bump 358 is provided along the area of reduced width 350. The bump 358 extends-outward such that the outermost portion of the bump 358 is substantially aligned with the edgeside surface 348 along the base portion 356. The signal contact 134 has a substantially similar cross-sectional area at the bump 358 as at the base portion 356. The bumps 358 may be used as a guidance feature when the signal contacts 134 are received in the contact channels 152 (shown in FIG. 2) of the housing 112 (shown in FIG. 2) of the receptacle assembly 102 (shown in FIG. 2). Because the contact channels receive a section of the base portion 356, the contact channels 152 have to be at least a certain size to accommodate the base portion 356. Because the mating portions 326 have a reduced cross-sectional area, the mating portions 326 may hot fit snuggly within the contact channels 152, which may cause the signal contacts 134 to be mis-aligned with the signal contacts 136 during mating. Such mis-alignment may cause damage to the signal contacts 134 and/or the signal contacts 134. The bumps 350 provide guidance to the signal contacts 134 and properly position the signal contacts 134 within the contact channels 152 to align the signal contacts 134 with the signal contacts 136 during mating.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a receptacle assembly and a header assembly coupled together, the receptacle assembly comprising:

an array of signal contacts having mating portions, the mating portions being female contacts, having a receptacle; and a housing holding the array of signal contacts in rows and columns, wherein the signal contacts are arranged along axes of the rows and columns, the mating portions of the signal contacts being oriented at a non-orthogonal angle relative to the axes of the rows and columns, wherein mating portions of the signal contacts in adjacent rows are angled in a common direction and mating portions of the signal contacts in adjacent columns are angled in a common direction; and the header assembly comprising:

an array of signal contacts having mating portions, the mating portions of the header assembly being male contacts received within the receptacles of the corresponding signal contacts of the receptacle assembly; and a housing holding the array of signal contacts of the header assembly in rows and columns, wherein the signal contacts of the header assembly are arranged along axes of the rows and columns the mating portions of the signal contacts of the header assembly being oriented at a non-orthogonal angle relative to the axes of the rows and columns, wherein mating portions of the signal contacts of the header assembly in adjacent rows are angled in a common direction and mating portions of the signal contacts of the header assembly in adjacent columns are angled in a common direction.

2. The assembly of claim 1, wherein the mating portions of the receptacle assembly and the header assembly have broadside surfaces, the broadside surfaces being angled at a first angle with respect to the row axes and the broadside surfaces being angled at a second angle with respect to the column axes, the first angle being approximately equal to the second angle to allow tighter spacing between both the rows and the columns.

3. The assembly of claim 1, wherein the mating portions of the receptacle assembly and the header assembly are generally planar and define mating planes, the mating planes being transverse to the column axes.

4. The assembly of claim 1, wherein the mating portions of the receptacle assembly and the header assembly extend along a central axis, the mating portions of the receptacle assembly and the header assembly being twisted about the central axes in common direction to approximately 45°.

5. The assembly of claim 1, wherein the housing of the receptacle assembly includes a plurality of walls, the row axes and the column axes are parallel to the walls of the housing of the receptacle assembly, the mating portions of the receptacle assembly being transverse to the walls of the housing of the header assembly the housing of the header assembly having a plurality of walls, the row axes and the column axes are parallel to the walls of the housing of the header assembly, the mating portions of the header assembly being transverse to the walls of the housing of the header assembly.

6. The assembly of claim 1, wherein the mating portions of a set of signal contacts of the receptacle assembly within a row each define mating planes being oriented such that the associated mating planes are aligned substantially parallel to one another and at an acute angle with respect to the axis of the row, and wherein the mating planes of the mating portions within the columns are oriented such that the associated mating planes are aligned substantially parallel to one another and at an acute angle with respect to the axis of the column.

7. The assembly of claim 1, wherein the housing of the receptacle assembly includes channels therethrough defined by channel walls, the channels are aligned with the signal contacts, the channels are arranged generally along channel row axes and channel column axes, the channel walls being transverse to the channel row axes and the channel column axes.

8. The assembly of claim 1, wherein the signal contacts of the receptacle assembly are stamped from a blank, the signal contacts of the receptacle assembly have opposed broadside surfaces and opposed edgeside surfaces defined by cuts of the blank, the mating portion is twisted with respect to the other portions of the signal contact such that the broadside surfaces and the edgeside surfaces of the mating portion are nonparallel to the broadside surfaces and the edgeside surfaces of other portions of the signal contacts,

9. The assembly of claim 1, further comprising a plurality of contact modules held by the housing of the receptacle assembly, the contact modules having a contact module body, the signal contacts being held by the contact module body along a conductor plane, the mating portions extend from an edge of the contact module body and are twisted such that the mating portions lie transverse to the conductor plane.

10. The assembly of claim 1, wherein the receptacle assembly further comprises:

a plurality of contact modules held by the housing, the contact modules having a contact module body, the signal contacts being held by the contact module body such that the mating portions extend from an edge of the contact module body and are arranged along a single column axis; and a plurality of shields coupled to corresponding contact modules, the shields having shield mating portions interspersed with the mating portions of selected signal contacts such that the shield mating portions are generally arranged along the column axes.

11. The assembly of claim 1, wherein each mating portion of the receptacle assembly extends along a central axis, the mating portion of the receptacle assembly being twisted about the central axis to approximately a 45° angle with respect to an adjacent portion of the signal contact and wherein each mating portion of the header assembly being oriented generally perpendicular with respect to the corresponding mating portion of the receptacle assembly.

12. The assembly of claim 1, comprising a plurality of contact modules held by the housing of the receptacle assembly, the signal contacts of the receptacle assembly being held by corresponding contact modules, each signal contact having an encased portion encased within the contact module body and extending along a conductor plane, the contact modules being held in the housing such that the signal contacts of the corresponding contact module are arranged in a column along the conductor plane, the mating portions extending from an edge of the contact module body, the mating portions having opposed broadside surfaces and opposed edgeside surfaces extending between the broadside surfaces, the mating portions being oriented such that the broadside surfaces are angled in common directions, the broadside surfaces being transverse to the corresponding conductor planes.

13. The assembly of claim 1, wherein the housings of the receptacle assembly and the header assembly are coupled together such that the column axes and row axes are aligned with one another, the mating portions of the receptacle assembly having broadside surfaces being oriented at approximately 45° with respect to the column axes and row axes and the mating portions of the header assembly having broadside surfaces being oriented at approximately 45° with respect to the column axes and row axes, the broadside surfaces of the mating portions of the receptacle and header assemblies being oriented approximately perpendicular to one another.

14. A connector assembly comprising:

a housing having a mating interface configured for engagement with a mating connector assembly;

a plurality of contact modules held by the housing, each contact module having a contact module body and a plurality of signal contacts held by the body, each signal contact having an encased, portion encased within the contact module body and extending along a conductor plane, the contact modules being held in the housing such that the signal contacts of the corresponding contact module are arranged in a column along the conductor plane, each signal contact having a mating portion extending from an edge of the contact module body, the mating portion being configured to engage a signal contact of the mating connector assembly, the mating portion having opposed broadside surfaces and opposed edgeside surfaces extending between the broadside surfaces, the mating portions being oriented such that the broadside surfaces are angled in common directions, the broadside surfaces being transverse to the corresponding conductor planes.

15. The assembly of claim 14, wherein the mating portion extends along a central axis, the mating portion being twisted about the central axis to approximately a 45° angle with respect to an adjacent portion of the signal contact.

16. The assembly of claim 14, further comprising a shield coupled to one side of each contact module body, the shield being parallel to and non-coplanar with the conductor plane thereof, the shield having shield mating portions that are aligned with and positioned between the mating portions of selected signal contacts.

17. The assembly of claim 14, further comprising a shield coupled to one side of each contact module body, the shield being positioned between adjacent contact modules when the contact modules are held within the housing.

18. The assembly of claim 14, wherein the contact module body is overmolded over the encased portions of the corresponding signal contacts, the mating portions being twisted at an edge of the contact module body.

19. The assembly of claim 14, wherein the housing has a top, bottom and opposite sides, the contact modules being loaded into the housing such that the contact modules are stacked adjacent to one another and hold the corresponding contacts in columns that are parallel to the sides of the housing, the mating portions being twisted such that the broadside surfaces of the mating portions are transverse to the sides of the housing.

20. The assembly of claim 14, wherein the encased portions of the signal contacts have broadside surfaces that are parallel to the conductor plane, the mating portions being twisted with respect to the encased portions such that the broadside surfaces of the mating portions are transverse to the broadside surfaces of the encased portions.

* * * * *